US005477789A

United States Patent [19]

Von Gunten

[11] Patent Number: 5,477,789

[45] Date of Patent: Dec. 26, 1995

[54] SHELF STRUCTURE

[76] Inventor: Lee Von Gunten, 64 Newtown Dr., Buffalo Grove, Ill. 60090

[21] Appl. No.: 327,039

[22] Filed: Oct. 21, 1994

Related U.S. Application Data

[63] Continuation of Ser. No. 678,128, Apr. 1, 1991.

[51] Int. Cl.[6] ..... A47B 9/02

[52] U.S. Cl. ..... 108/108; 211/908

[58] Field of Search ..... 108/108, 109, 108/107, 48, 42, 144, 186; 248/188.9, 243, 125, 910; 211/90

[56] References Cited

U.S. PATENT DOCUMENTS

| | | | |
|---|---|---|---|
| 2,958,427 | 11/1960 | Bianchi | 108/108 |
| 2,992,743 | 7/1961 | Wing | 211/90 |
| 3,040,905 | 7/1962 | Gingher et al. | 108/108 |
| 3,601,256 | 8/1971 | Bowers, Jr. et al. | 108/108 |
| 3,730,108 | 5/1973 | Stroh | 108/108 |
| 3,758,182 | 9/1973 | Barecki et al. . | |
| 4,204,480 | 5/1980 | Hannah | 108/108 |
| 4,444,323 | 4/1984 | Travis | 108/108 X |
| 4,526,110 | 7/1985 | Franz | 108/108 |
| 4,620,489 | 11/1986 | Albano | 108/108 X |
| 4,679,510 | 7/1987 | Veyhl et al. | 108/109 X |
| 4,716,841 | 1/1988 | Suttles | 108/108 |
| 4,756,430 | 7/1988 | Spamer | 108/108 X |
| 5,161,701 | 11/1992 | Berny | 108/108 X |
| 5,205,421 | 4/1993 | Bustos | 108/108 X |
| 5,348,385 | 9/1994 | Berg | 108/108 X |

FOREIGN PATENT DOCUMENTS

| | | |
|---|---|---|
| 1176809 | 1/1959 | Germany . |
| 268010 | 9/1923 | Italy . |
| 202774 | 9/1963 | Sweden . |
| 2027749 | 9/1963 | Sweden . |

*Primary Examiner*—Kenneth J. Dorner
*Assistant Examiner*—Rodney B. White
*Attorney, Agent, or Firm*—James P. Hanrath

[57] ABSTRACT

A post including a back post and leg, together constituting a one-piece member. The member is bent to form the back post and leg, and when it is in upright active position, the back post rests against the wall, and the leg extends forwardly at an acute angle to the back post. A foot is secured to the lower end of the leg, extending transversely and engaging the floor. The back post is provided with holes for receiving brackets. There is no mechanical connection between the post and the wall or floor.

15 Claims, 2 Drawing Sheets

SHELF STRUCTURE

This is a continuation of application Ser. No. 07/678,128 filed on Apr. 1, 1991, now abandoned.

BACKGROUND OF THE INVENTION

1. Field of the Invention.

The invention resides in the broad field of floor-supported shelves.

Cross References

Prior and co-pending application, No. 07/509,721, filed Apr. 16, 1991, of Judy Yon Gunten and myself.

2. Description of the related art

There is no known prior art bearing on the invention.

SUMMARY OF THE INVENTION

A broad object of the invention is to provide a novel shelf structure of the foregoing character, having the following features and advantages:

it is made up of very few parts, it is strong and stable, it presents an unusually good appearance, being of trim lines; and it has a lower portion that is very compact and well designed, where its compact arrangement presents an unusually good effect at the juncture of the wall and floor.

DESCRIPTION OF THE PREFERRED EMBODIMENTS

Figure 1:
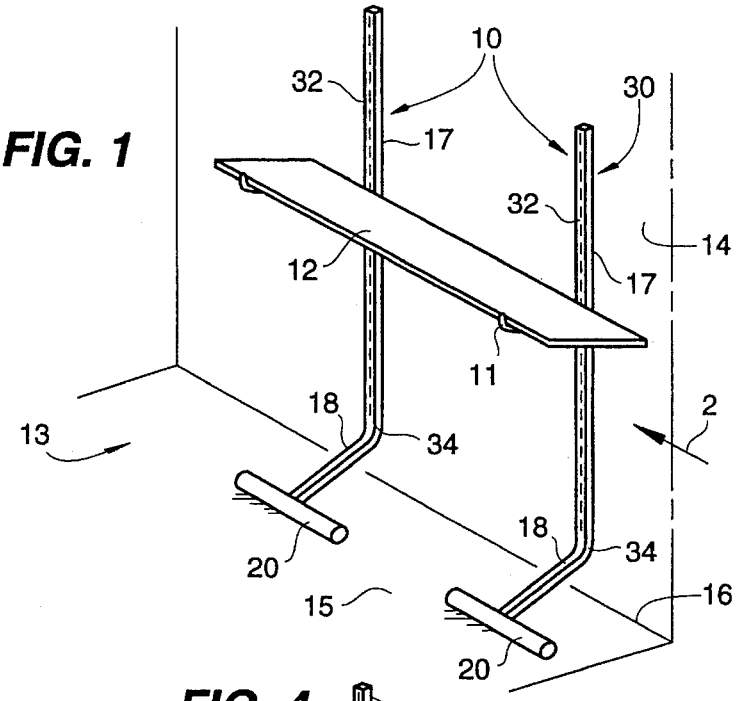
FIG. 1 is a perspective view of a pair of the posts of the invention and a shelf thereon.

FIG. 1 shows a pair of posts made according to the invention. In this case the posts are provided with brackets 11 and a shelf 12 to be referred to again hereinbelow. In FIG. 1 the two posts 10 are set up in upright or active position, spaced apart and supporting the shelf. The two posts are identical and a description of a single post will apply in all of the illustrations.

FIG. 1 shows the posts 10 in a space or room 13 having a wall 14 and a floor 15, the juncture therebetween being indicated by a line 16.

Each post is made up of a back post 17, a leg 18, and a foot 20. In this construction, the back post and leg are made of a single integral, one-piece member, while the foot 20 is a separate member, secured to the leg.

The back post/leg 17/18 is preferably an extruded tubular metal piece, polygonal in cross section and preferably square.

The post in upright active position, is so positioned with the foot 20 on and supported by the floor, and the back post 17 resting against the wall. The leg 18 is disposed at an obique angle 28 (FIG. 2) to the back post, and thus to the floor. The back post 17 engages the wall throughout substantially its own length, minor variations in surface area being accommodated.

The post is thus supported mainly by the floor, which receives basically the weight of the post and the load thereon, and the back post has friction engagement with the wall and thus supported by the wall, not only in direction against the wall, but against moving or sliding in transverse directions, i.e. along the surface of the wall.

When the post is in upright active position, it may be referred to as having a rear side 30 and a front side 32. As will be observed, the rear side is directed against the wall while the front side is directed to the interior of the room.

The foot 20 is positioned transverse to the leg 18 and when the post is in active position, it engages the floor essentially throughout its length, in one form, but as referred to hereinbelow, it may be constructed so as to engage the floor only at its ends.

The member making up the back post and leg is originally a straight piece, taken from an aggregate supply, and cut to the desired length, and then bent at point 34 which thereby constitutes a juncture between the back post and leg.

Figure 7:
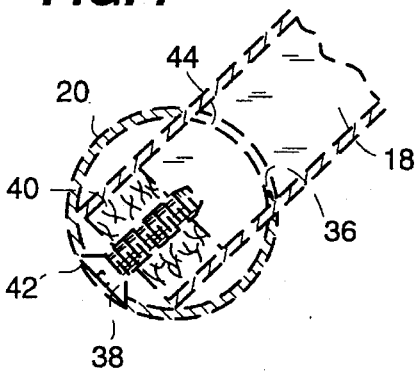
FIG. 7 is a sectional view taken at line 7—7 of FIG. 6.

The foot 20 is also preferably of metal, tubular in construction, and may be round in cross section and is provided with a recess 36 (FIG. 7) in one side. The lower end of the leg 18 is fitted in the recess, and is secured therein by means of a screw 38. Any suitable detail structure may be utilized for securing or locking the leg in the foot such as a plug 40 fitted in the leg, and securely anchored therein as by welding or staking. It has a tapped aperture receiving the threaded screw. The wall of the foot has a hole 42 receiving the screw and the screw head is held in engagement with that wall. The outer opening of the recess 36, at point 44, constitutes a point of engagement between the leg and the foot, and thus the interengagement between the leg and the foot is at two points, 44, 42, and thus spaced apart transversely of the foot at maximum positions, providing secure anchoring of the leg in the foot. The recess 36 is of a shape complementary to the cross-sectional shape of the leg, in this case square. The plug 40 constitutes one of various kinds of inserts for securing and locking the leg in the foot.

Figure 6:
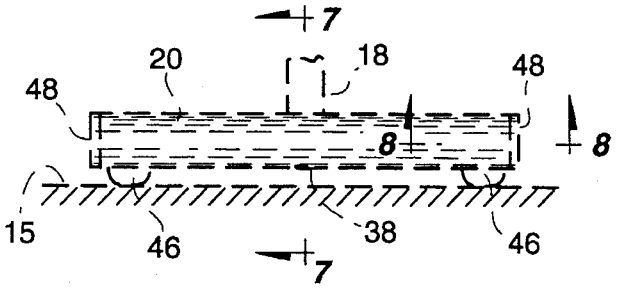
FIG. 6 is a view of the lower portion of FIG. 3, with additional details.
Figure 8:
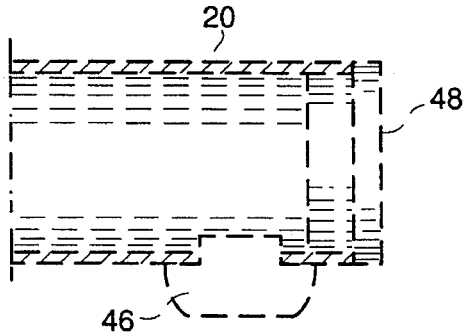
FIG. 8 is a sectional view taken at line 8—8 of FIG. 6.

The foot 20 is essentially straight, and thereby engages the floor throughout its own length, normally, when the floor is even, this engagement including that at the ends of the foot, which with the engagement of the post with the wall, provides 3-point support. However, due to occasional uneven or non-planar shapes, such as may often happen in wood floors, the foot may be provided with elements at its ends that directly engage the floor, such as shown in FIG. 6. Such elements are indicated at 46 and may be simple inserts or plugs (FIG. 8) snapped into holes in the wall of the foot. These inserts thus constitute floor engaging elements, and in the active position of the post, they are lower than the remaining points of the foot between those inserts. Therefore the inserts constitute two points at the end of the foot, for providing solid and stable support totally preventing wobbling of the post. However it is of course to be noted that any variations or unevenness in the floor are accommodated.

Preferably the foot 20 is cut from aggregate supply and to provide a pleasant appearance, and additional strength, plugs 48 (FIG. 8) are inserted in the otherwise open ends of the body of the foot, preferably by merely snapping them in. These plugs may be of metal or plastic, or other suitable material.

The single leg 18 and foot 20 provide a compact arrangement and trim appearance at the bottom of the post, at the juncture of the wall and floor.

Figure 2:
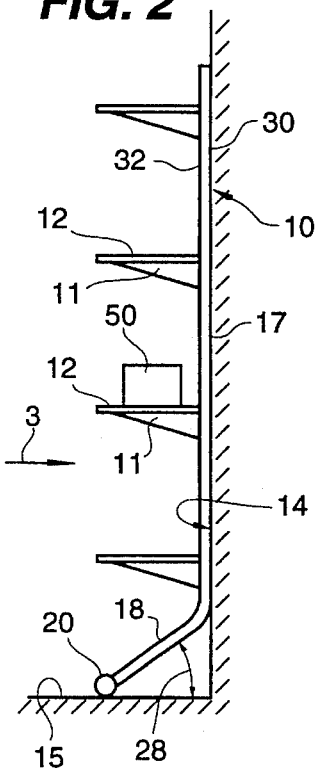
FIG. 2 is a side view taken in the direction of the arrow 2 of FIG. 1.

The back post 17 on its flat front side, is provided with a series of holes, elongated vertically, and vertically spaced throughout its length. These holes receive the brackets 11, which are of known kind, having hooks inserted in the holes. The shelves 12 are simple boards that rest on the brackets. FIG. 2 also shows a load 50 on a shelf. The mounting of the brackets and shelves, on the post, is similar to that in our prior application identified above, and the details need not be entered into herein. A similar situation exists in connection with the load 50, and the load will be referred to again hereinbelow in connection with FIG. 9.

Figure 4:
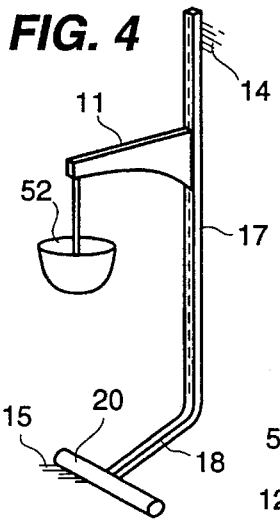
FIG. 4 is a perspective view showing a single post with a load supported thereon.
Figure 3:
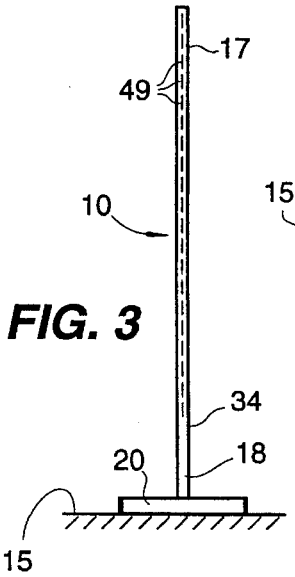
FIG. 3 is a front view, taken in the direction of the arrow 3 of FIG. 2.

While the posts are adapted for use with shelves, a single post can also be used to support an article. Such an arrangement is shown in FIG. 4, where a single post 10 is in active position, resting on the floor, and the back post 17 bearing against the wall 14. A single bracket 11 is mounted on the back post, supporting a load 52 represented by a flower pot.

Stability of the post exists where a single post is used as in FIG. 4, and it is not necessary to utilize shelves for aiding in the stability. The stability is provided by the engagement of the back post against the wall, and the engagement of the foot 20 with the floor at the ends of the foot.

Figure 5:
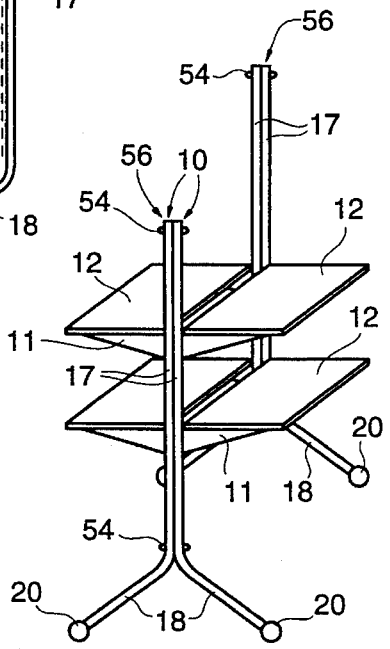
FIG. 5 is a perspective view of a pair of posts set together in back-to-back relation and with several such double posts bearing shelves.

The posts 16 may also be utilized in double, or back-to-back, arrangement, as shown in FIG. 5. In this Figure two posts are positioned back-to-back, with the back posts 17 thereof fitted together, and preferably secured together by bolts 54 to prevent the two individual posts 10 from sliding out of mutual engagement. These two posts 10 then constitute a double post 56, and a plurality of such double posts can be arranged in a series (FIG. 5). Brackets 11 may be mounted in the front sides of the individual posts 10, i.e., on opposite sides of the double posts, and shelves 12 placed on the brackets that are mounted in two or more double posts. This feature is also shown in our prior application identified above, and the presentation here exemplifies the stability of the present form of posts put in double-post arrangements.

Figure 9:
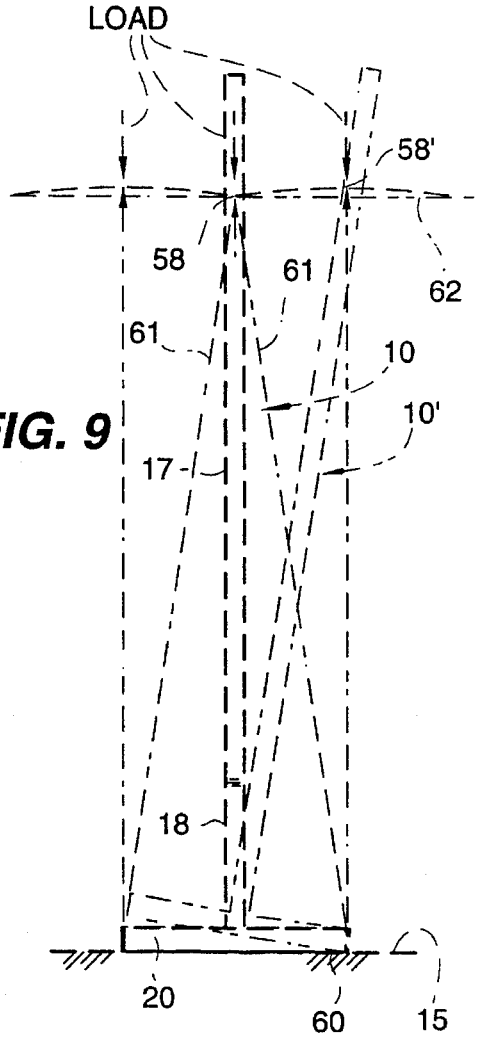
FIG. 9 is a front view of the post showing, in dot—dash lines, a tipping position.

FIG. 9 depicts the stability of the post in use. This is a front view, and on the back post is a point 58 where a load, i.e. 52, is supported, this point being where the bracket is mounted. Any tendency of the post to tip, or to be tipped, is counteracted by the load. In FIG. 9 the full line position is the upright active position, stabilized. Assume, for example, that the post were to be tipped in one direction, i.e. to the right (FIG. 9)—as it goes toward the dot-dash line 10', it of course pivots about the point 60 on the radius 61, and the point 58 where the load is suspended follows the arc 62 upwardly to its highest position at point 58'. The load tends to move the point downwardly, i.e., along the arc to the left, to its lowermost position, and thereby produces a stabilizing effect. An identical situation exists relative to the left half of the arrangement represented in FIG. 9.

This stabilizing effect exists whether a single post is used, or a number of posts with shelves used. It will be understood of course that this phenomenon intending to retain the post upright, is additive to the resistance provided by the engagement with the wall which maintains the post upright.

In the case of the double post, FIG. 5, each single post 10 provides a supporting means, or supporting surface to the other post, and thus functions in the same manner as a supporting wall, and as used herein, and particularly in the claims, each post may be referred to as a supporting wall.

I claim:

1. In a shelf structure or stand for supporting a load by cantilever bracket, a combination comprising a post having a front side and a rear side, and an upper end and a lower end, said post being capable of placement in an upright active position relative a floor adjacent a supporting surface, said front side having a plurality of vertically spaced slots adapted to releasably receive a cantilever bracket, leg means for self-stabilizing said post extending forwardly from said lower end of the post at an oblique angle thereto having a tubular supporting element with a length transverse of the post greater than its width at the lower end thereof, the post, when in said upright active position, having at least a portion of the rear side capable of being disposed against the supporting surface, and said leg means, when in said upright active position, having said supporting element capable of being disposed upon the floor, the post and leg means each being structurally independent of and free of fastening means for connection with any floor and supporting surface, surface, the post being supported when in said upright active position only by disposition of the leg means upon the floor and disposition of at least a portion of the rear side of the post against the supporting surface, due to said oblique angle and said tubular support element providing a force in a direction against the supporting surface and the post being self-stabilized when in said upright active position and supporting any load such that lateral destabilization thereof requires a lifting of any load supported by said post.

2. A combination according to claim 1 wherein the leg means includes a leg and a foot on a lower end of said leg, said foot including said supporting element.

3. A combination according to claim 2 wherein, the foot extends transversely of the leg and the foot contains at least two supporting elements at a lower portion of the foot.

4. A combination according to claim 2 wherein, the foot is tubular and includes a body formed from an aggregate length, said supporting element being formed by one or more inserts releasably snapped into one or more supporting holes in the foot, and the foot includes closure caps snapped into and closing the ends of the body.

5. A combination according to claim 1 and including a plurality of posts, brackets detachably mounted on the posts, and shelves mounted on horizontally aligned brackets of at least two posts.

6. A combination according to claim 2 wherein the post and leg together constitute a continuous one-piece member.

7. A combination according to claim 6 wherein the one-piece member is tubular.

8. A combination according to claim 7 wherein the one-piece member is polygonal in cross section.

9. A combination according to claim 1 wherein said leg means including a leg, and a transverse foot on a lower end of said leg, and said transverse foot including said supporting element and having an opening complementary in shape to a cross sectional shape of the leg and detachably receiving the leg, and said traverse foot or said leg having means for releasably securing the foot to the leg.

10. A combination according to claim 9 wherein, the foot is tubular, the opening extends from one side of the foot transversely to the opposite side thereof, and the leg, and post, when secured together, having points of inter-engagement located at opposite marginal edges of the foot transversely of the foot.

11. A combination according to claim 9 wherein, the post and the leg are tubular, and tile means for securing the foot to the leg includes an insert in and fixedly secured to the leg, and a screw extending through a wall of the leg and engaging that wall and secured in the insert.

12. A combination according to claim 1 and including, a pair of such posts in back-to-back relation, and the rear side of each post of each post of the pair of the posts constituting support for the other post of the pair of posts.

13. A combination according to claim 1 wherein the leg means have a plurality of supporting elements at the lower end thereof constituting elements capable of being disposed upon the floor when in an upright active position only at spaced locations transversely of the post.

14. A combination according to claim 13 wherein said plurality of supporting elements are capable of being disposed upon the floor at a point lower than all portions of said leg means between said supporting elements, when said post is in said upright active position.

15. A combination according to claim 1 wherein the front side of said post has said plurality of vertically spaced slots distributed substantially throughout its length.

* * * * *